United States Patent [19]

Mendel

[11] Patent Number: 4,727,298

[45] Date of Patent: Feb. 23, 1988

[54] TRIGGERED PLASMA OPENING SWITCH

[75] Inventor: Clifford W. Mendel, Albuquerque, N. Mex.

[73] Assignee: The United States of America as represented by the Department of Energy, Washington, D.C.

[21] Appl. No.: 884,858

[22] Filed: Jul. 14, 1986

[51] Int. Cl.[4] ..... H01J 17/00; H01J 1/50; H05B 37/00

[52] U.S. Cl. ..... 315/340; 315/39; 315/344; 315/290; 315/111.01; 313/231.31; 313/157; 313/325

[58] Field of Search ..... 315/344, 111.41, 338, 315/340, 39; 250/396 R; 313/157, 231.31

[56] References Cited

U.S. PATENT DOCUMENTS 4,596,945 6/1986 Schumacher et al. ..... 315/344
4,639,643 1/1987 Donaldson et al. ..... 315/344

OTHER PUBLICATIONS

Meger et al., "The NRL Plasma Erosion Opening Switch Research Program," Proceedings of Fifth International Conference on High Power Particle Beams, San Francisco, Calif. 1983, p. 330.

Mendel et al., "Performance of a Plasma Filled, Series Field Coil Ion Beam Diode," J. Appl. Phys. 53(11), 11/1982, pp. 7265-7273.

Meger et al., "Vacuum Inductive Store/Pulse Compression Experiments", Appl. Phys. Lett. 42(11) 6/1983, pp. 943-945.

Mendel, "Analytical Theory of Series Field Coil Ion Diodes," Phys. Rev. A, 27, 6/1983 pp. 3258-3273.

C. Mendal et al, "Series-Field-Coil Ion Beam Diode Exepriment and Numerical Simulation, J. Appl. Phys. 56, 1984 p. 637.

Mendel et al., "A Fast Opening Switch for use in Reb Diode Experiments," J. of Appl. Phys., vol. 48(3), 3/1977 pp. 1004-1006.

Kozlouskii et al, "Use of Laser Plasma Anode in a Magnetically Insulated Ion Diode", Sov. Phys. Temp. 25(6), 6/1980 p. 6946.

Mendel et al., "Carbon Plasma Gun," Rev. Sci. Instru. 51(121 12/1980, pp. 1641-1644.

Springfield et al, "Plasma Erosion Switches with Imploding Plasma Loads on a Multiterawatt Pulsed Pwr. Gen." J. Appl. Phys. 52/3, 1981, pp. 1278-1284.

*Primary Examiner*—David K. Moore
*Assistant Examiner*—Mark R. Powell
*Attorney, Agent, or Firm*—George P. Libman; James H. Chafin; Judson R. Hightower

[57] ABSTRACT

A triggerable opening switch for a very high voltage and current pulse includes a transmission line extending from a source to a load and having an intermediate switch section including a plasma for conducting electrons between transmission line conductors and a magnetic field for breaking the plasma conduction path and magnetically insulating the electrons when it is desired to open the switch.

8 Claims, 4 Drawing Figures x

TRIGGERED PLASMA OPENING SWITCH

The U.S. Government has rights in this invention pursuant to Contract No. DE-AC04-76DP00789 between the Department of Energy and AT&T Technologies, Inc.

This invention relates generally to a fast opening switch for very high power applications, and more particularly to a transmission line between a power supply and load that is shorted by a plasma and controllably opened by a magnetic field.

BACKGROUND OF THE INVENTION

Pulse power technology often needs very short, ultra-high power pulses. For example, certain light ion fusion experiments require pulses of 10–15 ns and $10^{13}$–$10^{14}$ W. These pulses could be attained with a fast opening switch of sufficient speed, current carrying capability and voltage hold-off capability, as power could be stored in inductors and released by the switch.

The problem with prior art switches is that all the necessary characteristics cannot be obtained in one switch. For example, explosively activated circuit breakers and wire fuses are triggerable, but do not have sufficient speed or hold-off capability.

A switch that overcame the problems of opening speed and power handling capability was reported by C. Mendel et al., "A fast-opening switch for use in REB diode experiments," Journal of Applied Physics, Vol. 48, No. 3, March 1977, page 1004. This plasma opening switch has been further developed since 1977, but, until this invention, it was not triggerable.

SUMMARY OF THE INVENTION

It is an object of this invention to provide a triggerable plasma opening switch.

It is another object of this invention to provide a plasma opening switch using a triggerable magnetic field to block the current to the plasma.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the present invention may comprise an anode and a cathode having input ends connectable to an ultra-high pulse power supply and output ends connectable to a load. A switch portion of the cathode is spaced from a switch portion of the anode by a gap filled by a plasma. When the power supply is pulsed, electrons flow from the cathode to the plasma and, subsequently, to the anode, shorting the current from the load. A magnetic field is controllably generated perpendicular to the electron flow to force a gap between the plasma and one of the electrodes, and to magnetically insulate the gap, thereby opening the switch.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
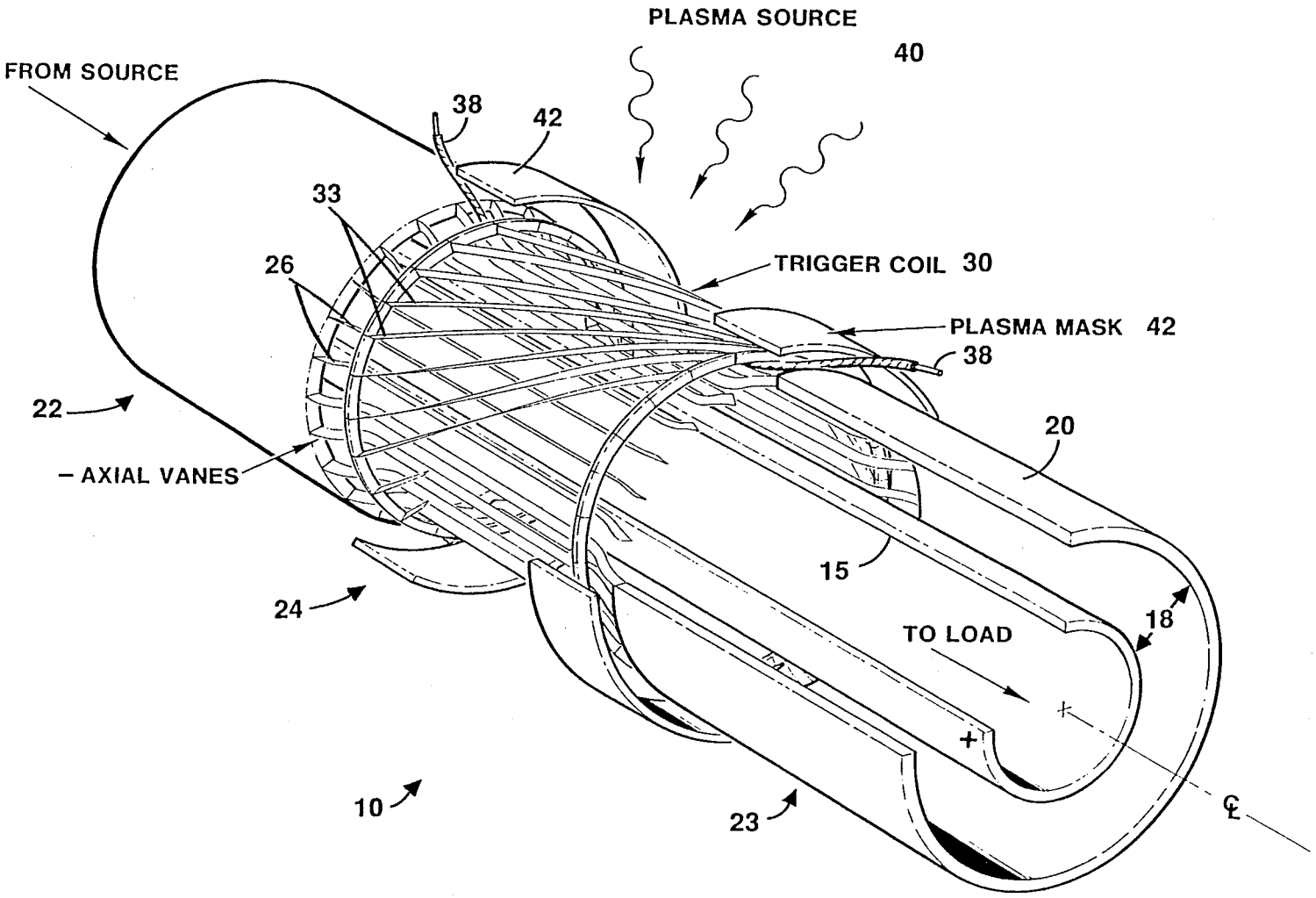
FIG. 1 shows a cutaway view of a preferred embodiment of the invention.

As shown in FIG. 1, a magnetically insulated plasma opening switch 10 includes a coaxial transmission line formed of generally cylindrical coaxial metal cylinders 15 and 20 having input ends 22 connectable across a megavolt, megampere power supply, and output ends 23 connectable across a load. A switch portion 24 is between the ends of each cylinder. The outer surface of inner cylinder 15 is separated from the inner surface of outer cylinder 20 by a gap 18. In the preferred embodiment shown, inner cylinder 15 is the positive electrode and outer cylinder 20 is the negative electrode.

According to the invention, electrons from the source flow along the input end 22 of outer cylinder 20 to switch portion 24, across gap 18 to switch portion 24 of inner cylinder 15, and through input end 22 of inner cylinder 15 to the source. When the switch is triggered, the current flowing across gap 18 suddenly stops, sending the electrons along the output end 23 of outer cylinder 20, through the load, and back through inner cylinder 15 to the source.

The current is caused to flow across the gap by a plasma placed within the gap between the switch portions of the cylinders. A plasma, as is well known, contains many free electrons and is highly conductive. A thin gap (typically much less than one millimeter) known as a sheath, containing few ions, forms between the cathode and the plasma. Prior to the application of the magnetic field, the electron current easily crosses this sheath. However, when a magnetic field is generated with field lines parallel to the sheath, the magnetic field repels the plasma, thereby increasing the distance across the gap to several millimeters or more. In addition, the magnetic field insulates the gap, further preventing the flow of electrons across the gap.

In the embodiment of FIG. 1, plasma is generated by a plasma source 40, which source may be any known plasma generating structure such as a plasma gun or a flashover source located outside outer cylinder 20 for applying a plasma radially inward. An annular plasma mask 42 may be positioned between plasma source 40 and cylinder 20 to confine the plasma to switch portion 24.

The magnetically insulating field is provided by a trigger coil 30 axially aligned with, and spaced from, switch portion 24 of outer cylinder 20. Trigger coil 30 must be relatively low inductance because of the very high current it will pass, solidly constructed to prevent variations in the magnetic field caused by movement of the coils, permeable to the plasma from source 40, and able to generate a magnetic field within gap 18. Accordingly, coil 30 preferably includes a pair of equal-sized rings 31 and 32 defining the ends of the coil and a coil cylinder therebetween, and a plurality of rigid metal vanes 33 evenly spaced from each other and extending between rings 31 and 32 along the surface of the coil cylinder at an angle to the switch axis. Although leads 38 are shown for connecting coil 30 to a power source (not shown), it should be understood that low inductance connections to the power source would be used in the preferred embodiment.

If outer cylinder 20 was constructed of solid metal, as is conventional for transmission lines, the plasma from source 40 and the magnetic field from coil 30 would be blocked from gap 18. Therefore, switch portion 24 of outer cylinder 20 is provided with a plurality of parallel metal vanes 26 evenly spaced around the circumference of cylinder 20. These vanes permit plasma from source 40 and the magnetic field from coil 30 to go through outer cylinder 20 to gap 18 at switch portion 24.

Vanes 26 are preferably parallel to the axis of switch 10 because this construction keeps electrons flowing in cylinder 20 parallel to the axis in switch portion 24. If the electrons could move in directions other than parallel to the axis, they would generate magnetic fields that would adversely effect the operation of the device.

The relationship between vanes 26 of cylinder 20 and vanes 33 of coil 30 must be such as to permit enough magnetic field to pass from coil 30 through vanes 26 to gap 18 for operation of the switch. An angle of 65 degrees was found in one embodiment to provide good mechanical strength for coil 30 and generate in response to a pulse input a magnetic field that substantially passes through axially arranged cylinder vanes 26.

Figure 2A:
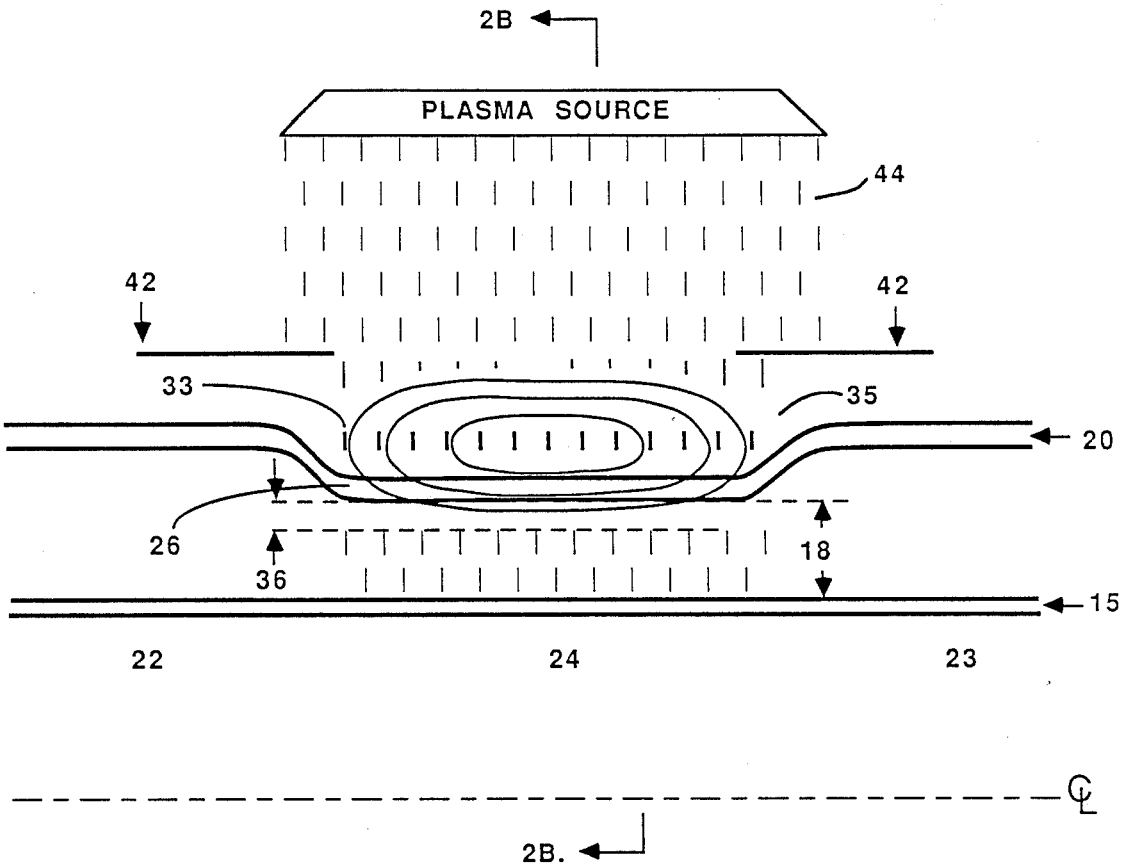
FIGS. 2*a* and 2*b* show representations of the embodiment of FIG. 1.
Figure 2B:
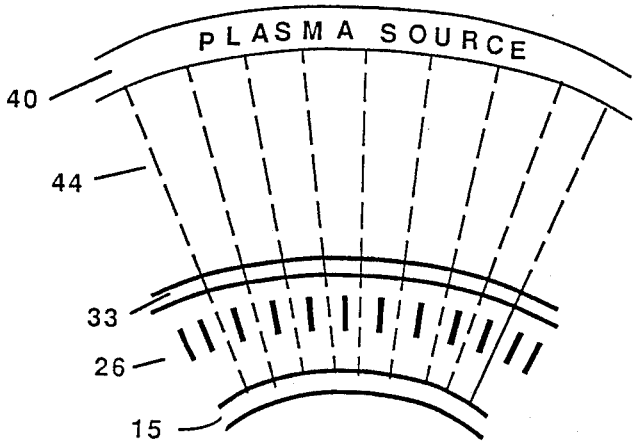

The operation of the device may be understood by reference to FIGS. 2A and 2B which show an axial and radial slice, respectively, of an embodiment of the invention having vanes 33 at 90 degrees to the axis.

Referring first to FIG. 2B, which figure is looking into the invention from the source and shows the operation before the coil 30 is energizes, a plasma 44 extends from plasma source 40 through vanes 33 and 26 to gap 18. A thin sheath 36, too small to be shown in Figure, separates plasma 44 from each cathode vane 26, as discussed above. Electrons from the source flow to vanes 26 where they jump sheath 36 and are conducted through the conductive plasma 40 in gap 18 to positively charged cylinder 15 and return to the source. The current is thus shorted by the plasma in the gap and prevented from proceeding along cylinder 20 to the load at the end opposite the source.

When the operator desires to trigger a current pulse to the load, a trigger signal is applied to coil 30, generating a magnetic field 35 extending between the ends, and on both sides, of coil 30, as shown in FIG. 2A. Plasma 44 is repelled by magnetic field 35 because magnetic field lines cannot penetrate the conducting plasma and, therefore, exert pressure on the plasma, forcing it away from the field coil. Because the magnetic field 35 extends radially through vanes 26 towards cylinder 15, plasma 44 in gap 18 is pushed away from vanes 26, greatly increasing the size of gap 36 in plasma 44 between vanes 26 and cylinder 15. Since electrons from cylinder 20 need the conducting plasma to move across gap 18, the current flow is broken. The plasma is also pushed away from coil 30 towards plasma source 40; however, since the outer conductor 20 is at basically the same potential as the surrounding vacuum chamber (not shown), the electrons have no tendency to be conducted towards the plasma source.

Another reason for the break in current is the magnetic insulation of cylinder 20 from cylinder 15 provided by magnetic field 35. Electrons emitted from vanes 26 tend to move towards cylinder 15 along a perpendicular path; the shortest possible line. When an intense magnetic field is applied in a direction transverse to the electron flow, the electrons, being very light charged particles, spiral around the magnetic field lines of force in a direction parallel to vanes 26 and perpendicular to their original direction of travel. Accordingly, magnetic insulation of the electrons by the magnetic field 35 also prevents the current flow across gap 36.

Once magnetic field 35 prevents the electron current flow across gap 18, the current follows the lowest impedance path to the positively charged cylinder 15; i.e., electrons flow through output section 23 of cylinder 20 and through the load to cylinder 15.

Figure 3:
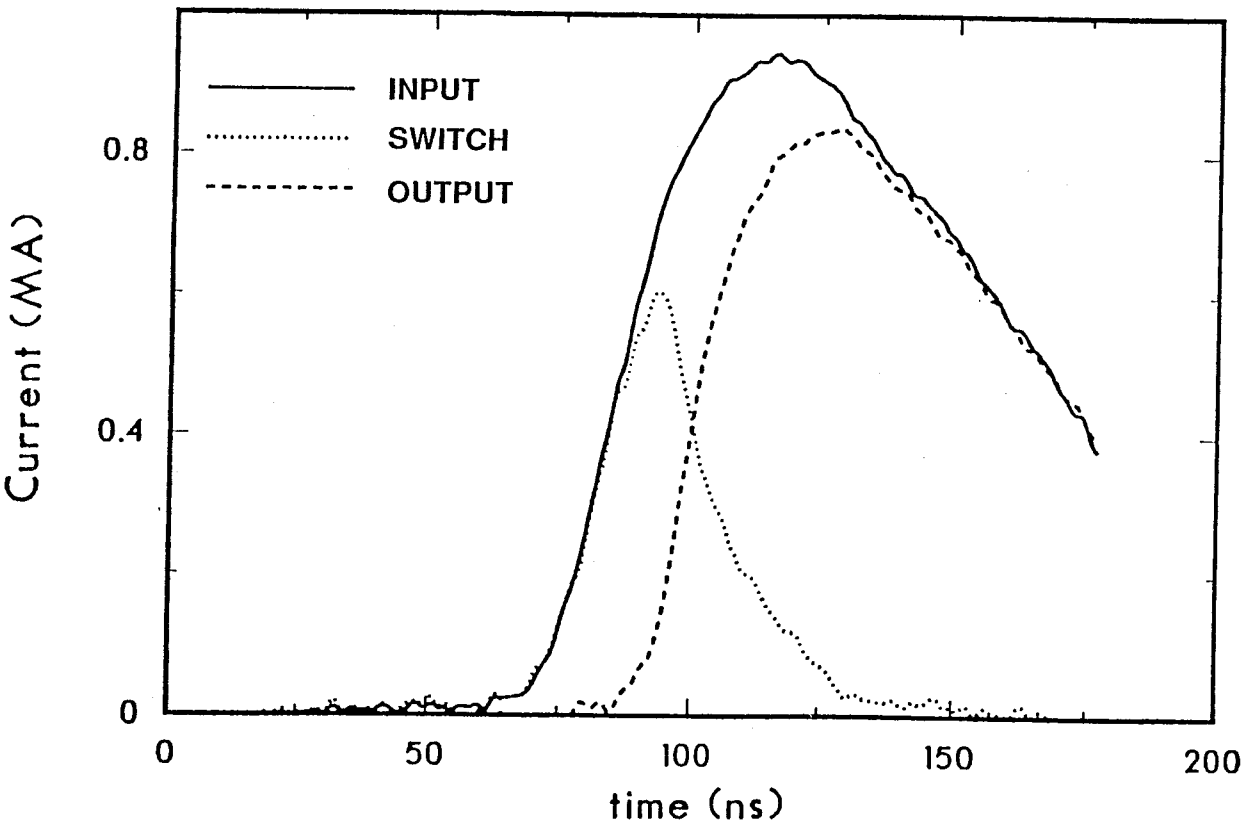
FIG. 3 shows the performance of a switch built in accordance with this invention.

FIG. 3 shows results of a test of an embodiment of the invention using a 2.6 MV, 0.8 MA, 45 ns pulse. The apparatus of this embodiment used an outer cylinder 20 having a diameter of 35 cm and an inner cylinder 15 having a diameter of 25 cm. The gap 18 was approximately 5 cm. For this test, coil 30 was connected in series with the load, and was thus self triggering. A plasma was provided in gap 18 by 6 plasma guns arranged annularly around the device.

As shown in FIG. 3, the output current to the load is delayed from by about 20 ns from the input current; the time it took the series coil to charge to the point of creating the magnetic field 35 to block the current from bypassing the load through the plasma.

As shown in FIG. 1, switch portion 24 of outer cylinder 20 has a reduced diameter, and coil 35 has a diameter approximately equal to the diameter of sections 22 and 24 of cylinder 20. This construction should ensure that electron flow between cylinders occurs only at switch section 24. However, in the experiment reported in FIG. 3, outer cylinder 20 was of constant diameter and coil 35 of greater diameter.

It should be understood that the operation of the magnetic insulation requires switch 10 to be operated in a vacuum environment such as a vacuum chamber.

The particular sizes and equipment discussed above are cited merely to illustrate a particular embodiment of this invention. It is contemplated that the use of the invention may involve components having different sizes and shapes as long as the principle, using a magnetic field to impress a gap for current to cross and magnetic insulation to further block the current flow across the gap, is followed. It is intended that the scope of the invention be defined by the claims appended hereto.

I claim:

1. A triggerable plasma opening switch for connecting a megavolt, megampere power supply to a load comprising:

cathode means having an input end, an output end, and a switch portion between the ends;

anode means having an input end, an output end, and a switch portion between the ends and spaced from the switch portion of said cathode means by a gap;

whereby the power supply is connectable between said input ends and the load is connectable between said output ends;

plasma source means for filling said gap with a plasma for providing a current path for shorting current from said load; and triggering means for generating a magnetic field for controllably moving said plasma away from one of said anode or said cathode to generate an insulating gap and to block the electron flow across said gap, thereby opening said switch and permitting current to flow from said power supply to said load.

2. The triggerable plasma opening switch of claim 1 wherein said cathode means and said anode means are coaxial metal cylinders of different diameters.

3. The triggerable plasma opening switch of claim 2 wherein said anode means is inside said cathode means.

4. The triggerable plasma opening switch of claim 3 wherein said means for generating a magnetic field consists of a trigger coil connectable to a source of electrical energy said coil being coaxially aligned with, and of larger diameter than, said switch portion of said cathode means; and said switch portion of said cathode consisting of a plurality of parallel, spaced, metal vanes extending around the circumference of said cathode, said vanes being aligned with the axis of said cathode.

5. The triggerable plasma opening switch of claim 4 wherein said plasma source comprises means external to said trigger coil for generating a plasma around the circumference of said trigger coil; and said trigger coil consists of a plurality of parallel, spaced, metal vanes, said coil vanes crossing said cathode vanes at an angle.

6. The triggerable plasma opening switch of claim 5 wherein said cathode vanes are connected electrically in parallel.

7. The triggerable plasma opening switch of claim 6 wherein said switch portion of said cathode has a smaller diameter than the input and output portions of said cathode.

8. The triggerable plasma opening switch of claim 7 wherein said trigger coil has an axial length less than the axial length of said switch portion of said cathode, the diameter of said trigger coil being approximately equal to the diameters of the input and output portions of said cathode.

* * * * *